US010112732B2

(12) United States Patent
Schmidhuber

(10) Patent No.: US 10,112,732 B2
(45) Date of Patent: Oct. 30, 2018

8
(54) FORMATTING CONTAINER

(71) Applicant: MULTIPOND Wägetechnik GmbH, Waldkraiburg (DE)

(72) Inventor: Josef Schmidhuber, Kraiburg (DE)

(73) Assignee: MULTIPOND WÄGETECHNIK GMBH, Waldkraiburg (DE)

( * ) Notice: Subject to any disclaimer, the term of this patent is extended or adjusted under 35 U.S.C. 154(b) by 412 days.

(21) Appl. No.: 14/926,244

(22) Filed: Oct. 29, 2015

(65) Prior Publication Data

US 2016/0122052 A1 May 5, 2016

(30) Foreign Application Priority Data

Oct. 29, 2014 (EP) ..... 14190956.4

(51) Int. Cl.

| | |
|---|---|
| ***B65B 39/02*** | (2006.01) |
| ***B65D 6/02*** | (2006.01) |
| ***B65D 6/00*** | (2006.01) |
| ***B65B 39/00*** | (2006.01) |
| ***B65B 65/02*** | (2006.01) |

(52) U.S. Cl.
CPC ..... *B65B 39/02* (2013.01); *B65B 39/003* (2013.01); *B65B 65/02* (2013.01); *B65D 7/06* (2013.01); *B65D 7/42* (2013.01)

(58) Field of Classification Search
CPC ..... B65B 39/003; B65B 39/02
See application file for complete search history.

(56) References Cited

U.S. PATENT DOCUMENTS 3,390,918 A * 7/1968 Reinke ..... A01F 25/186 406/159
3,731,451 A 5/1973 Sexstone
4,545,446 A * 10/1985 Kokabu ..... G01G 13/18 105/282.2

(Continued)

FOREIGN PATENT DOCUMENTS

DE 25 52 182 A1 6/1976
DE 10 2012 110 80 A1 5/2014
JP H08-119228 A 5/1996

(Continued)

OTHER PUBLICATIONS

Extended European Search Report dated Jan. 27, 2015 of the priority EP application; machine translation of portions of the report is provided.

(Continued)

*Primary Examiner* — Timothy L Maust
*Assistant Examiner* — Timothy P Kelly
(74) *Attorney, Agent, or Firm* — Hassan Abbas Shakir; Katten Muchin Rosenman LLP

(57) ABSTRACT

A container for use in a scale or combination scale, for example, which is used as formatting container includes two or more side walls, whose position with respect to each other is variable. The outlet of the container is closed by two or more opening flaps that are pivotable or swingable and, therefore, can release the outlet of the container. A common drive moves the side walls and the opening flaps. Therefore, a container can be entirely emptied, as blocked or accumulated product parts can drop downwards via enlargement of the cross section of the container by a movement of the side walls.

14 Claims, 4 Drawing Sheets

(56) References Cited

U.S. PATENT DOCUMENTS

| | | | | |
|---|---|---|---|---|
| 5,349,996 | A * | 9/1994 | McGregor | B65B 39/04 141/10 |
| 2015/0284116 | A1* | 10/2015 | Veix | B65B 25/00 53/436 |

FOREIGN PATENT DOCUMENTS

| | | | |
|---|---|---|---|
| JP | 2007284145 | A | 10/2007 |
| WO | 2006/131135 | A1 | 12/2006 |

OTHER PUBLICATIONS

Office Action dated Oct. 6, 2016 by the European Patent Office in related application EP 14 190 956.4, partial machine translation provided.

* cited by examiner

FORMATTING CONTAINER

BACKGROUND OF THE INVENTION

1. Field of the Invention

The present invention relates to a formatting container, for example for use in a system of packaging machine and portioning machine, as for example a scale or a volumetric filler.

2. Discussion of the Related Art

When manufacturing for example long, thin packagings, a product is usually added via respectively narrow pipes to a packaging machine. Herein, a product comes from an upstream portioning machine, like a scale. Thereby, it often occurs that the product does not leave the upstream portioning machine as a compact portion and therefore has to reach the packaging machine via a narrow pipe or a funnel. Therefore, it is possible that it has to be waited until all product parts relating to one portion have reached the packaging machine. As a pipe which connects portioning machine and packaging machine is often narrow, for example if slim packagings are to be manufactured, it is even possible in certain cases that dosing of a complete portion at the entrance of the pipe has to be avoided, so that the product does not wedge or pile up.

There is one possibility to discard the product from the portioning machine subsequently, successively or in a staggered manner to avoid a congestion at the entrance of the pipe. From a functional view, this solution is possible, however it has the significant disadvantage that a positioning- and filling-process entails an increased expenditure of time. Therefore, the maximum possible performance of packages per time unit is limited.

This solution however entails still the further disadvantage that a wedging of the product is not only possible at the entrance of the pipe, but also in the further course of the pipe. This occurs as single parts of the product are slowed down via friction at the walls of the pipe and thus, they can decelerate, and therefore they can also change their falling direction, thereby, however, colliding with other product parts, they can increase the pressure onto the walls, and, hence even increase the friction. The dropping in the pipe is thereby disturbed or hindered. Also this problem leads to a reduction of the possible performance in terms of packages per time unit. Furthermore, pipe walls can be contaminated by adhesion of product particles thereto, whereby even further increased friction occurs and hygienic problems can arise.

A further embodiment of the prior art is the provision of a container above the entrance of the pipe or a funnel for collecting the unevenly arriving product parts. In many applications, such collection containers are already provided. A collection container is usually formed according to the pipe diameter, respectively, and is therefore formed in a long and slim manner. Therefore, a portion of the product can be collected in a certain time interval and can be released as a complete portion in a compact manner. The collection container therefore has also the function to format the portion, being the reason why the collection container is also called "formatting container" in the following. However, a product congestion or a wedging or adhering of products can also occur in this collection container.

Therefore, a solution according to the prior art entails significant disadvantages.

SUMMARY OF THE INVENTION

It is therefore an object of the present invention to provide a formatting container which solves the above-mentioned problems. It is therefore necessary to provide a formatting container, which can discharge a product as an entire portion in a compact manner, being simultaneously formed in a way, that no product congestion can occur within the formatting container, which could lead to wedging or adhering of products, so that the formatting container is entirely drainable. Such a formatting container can be inserted into a system of a portioning machine and a packaging machine.

This object is solved by a formatting container comprising two or more side walls as circumferential boundary, the side walls including an internal space with an inlet and an outlet, wherein the outlet of the container is sealable, wherein the internal space is designed in a way, that the position of the side walls with respect to each other is variable, whereby the cross section of the container is variable.

The problem is also solved a scale comprising the aforementioned container.

The problem is also solved by a combination scale comprising the aforementioned container.

The problem is also solved by a process where the aforementioned container is used and the process includes firstly releasing of the outlet occurs, and subsequently the extension of the cross section of the container occurs via movement of the side walls.

The invention includes a formatting container, which preferably has an elongated, thin shape. In the vicinity of the entry of the formatting container, the cross section can be larger, whereas the cross section of the formatting container at the outlet can be smaller, so that a frustum of a cone is formed. Side walls of the formatting container are provided as movable side walls, wherein one side wall forms the one half, and the other side wall forms the opposing half of the side walls. The side walls can overlap in a way that a closed space is formed in the interior of the formatting container.

A movability of the side walls is provided in radial direction, so that an extended, but still substantially closed interior space is formed.

Further, the outlet of the formatting container is closed with two opening flaps. These are pivotably supported and can be pivoted away, so that the outlet of the container is released.

Below the container, a funnel is provided, wherein the inner diameter of the formatting container is preferably smaller than the inner diameter of the funnel.

BRIEF DESCRIPTION OF THE DRAWINGS

In the following, a preferred embodiment is explained more in detail with reference to the enclosed figures.

FIG. 4(*a*) describes a state, in which the container is filled with a share of the product portion.

FIG. 4(*b*) describes a state, in which the opening flaps are in an opened state.

FIG. 4(*c*) describes a state, in which the cross section of the container 1 has changed via movement of the side walls.

FIG. 4(*d*) describes a state, in which the/one complete product portion has moved out of the container and is located in the funnel.

FIG. 4(*e*) shows a state, which is equal to the state of FIG. 4(*a*) with regard to the configuration of the container.

DETAILED DESCRIPTION OF THE INVENTION

First Embodiment

Figure 1:
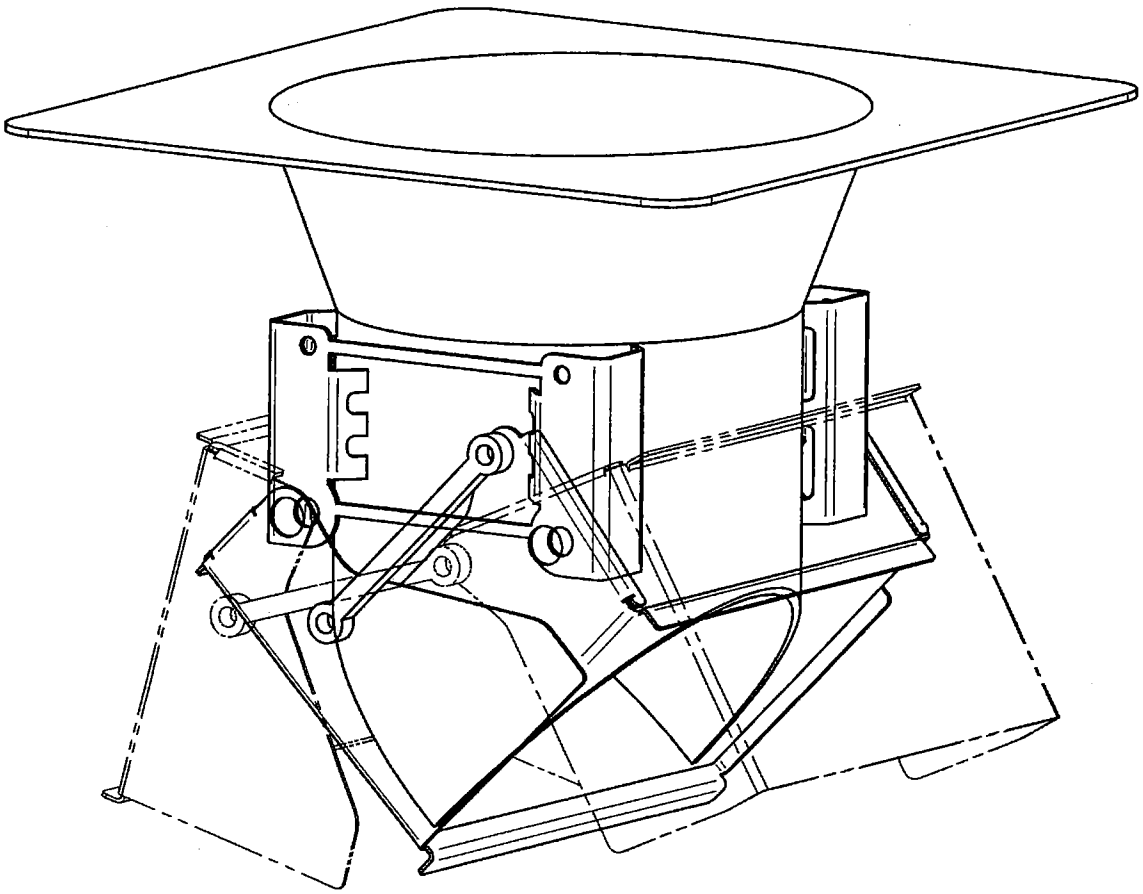
FIG. 1 is an isometric view of a conventional formatting container.
Figure 2:
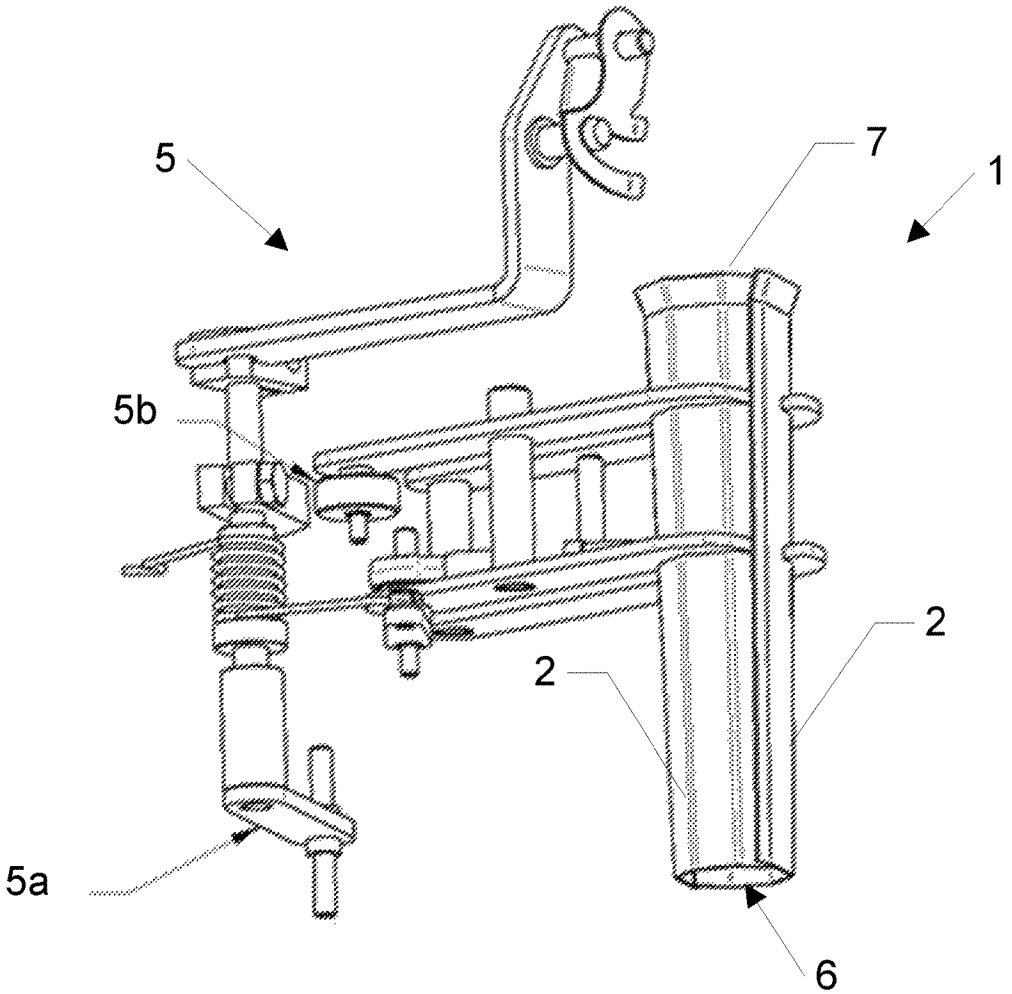
FIG. 2 is an isometric view of a formatting container with adjustable side walls and the associated driving elements according to one embodiment of the invention.

FIG. 2 shows a container 1, which comprises two side walls 2, which define the circumference of an interior. The container 1 is thereby formed in an open manner towards its upper and lower side. Furthermore, both side walls 2 are connected with a drive 5, which can cause the side walls 2 to move away from each other or towards each other. Altogether, the container 1, being formed by both side walls 2, has a conical interior shape, as one slightly larger cross section at an entry 7 opposes a smaller cross section of an outlet 6, so that a frusto-conical shape is present in this case. Furthermore, the container 1 has an approximately octagonal cross section. Therefore, one side wall 2 has four segments, which respectively are bent with a predetermined angle towards each other, in order to form an envelope curve. Therein, a segment which is aligned at the outer side of each side wall, is wider than the remaining segments. Preferably, both side walls 2 have the same cross section area and are aligned in an axially symmetrical manner towards each other. The container 1 is shown in a closed state. Herein, one side wall forms the one half, the other opposing side wall forms the other half of the container 1. In this case, the side walls overlap in a way that they form a closed space in the interior. Further details regarding the closed and open state of the container 1 are depicted in FIGS. 4(*a*) to 4(*e*).

Figure 3:
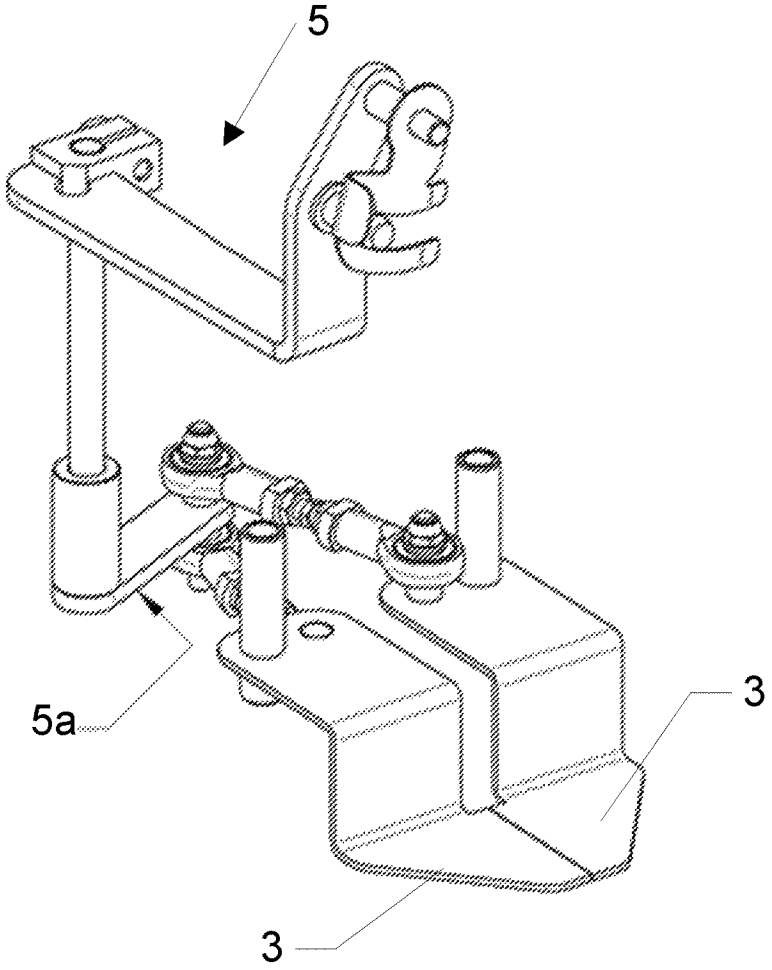
FIG. 3 is an isometric view of the opening flaps, which are connected with driving elements.

FIG. 3 said the drive 5, being connected with said two opening flaps 3. Both opening flaps 3 are a bent metal member, wherein the state of the opening flaps 3 in FIG. 3 is shown in the closed state. Herein, one side edge of both opening flaps aligned in an axially symmetrical manner is in contact, so that they form a closed bottom, which can close the outlet 6, as shown in FIG. 4(*a*).

Figures 4A, 4B, 4C, 4D, 4E:
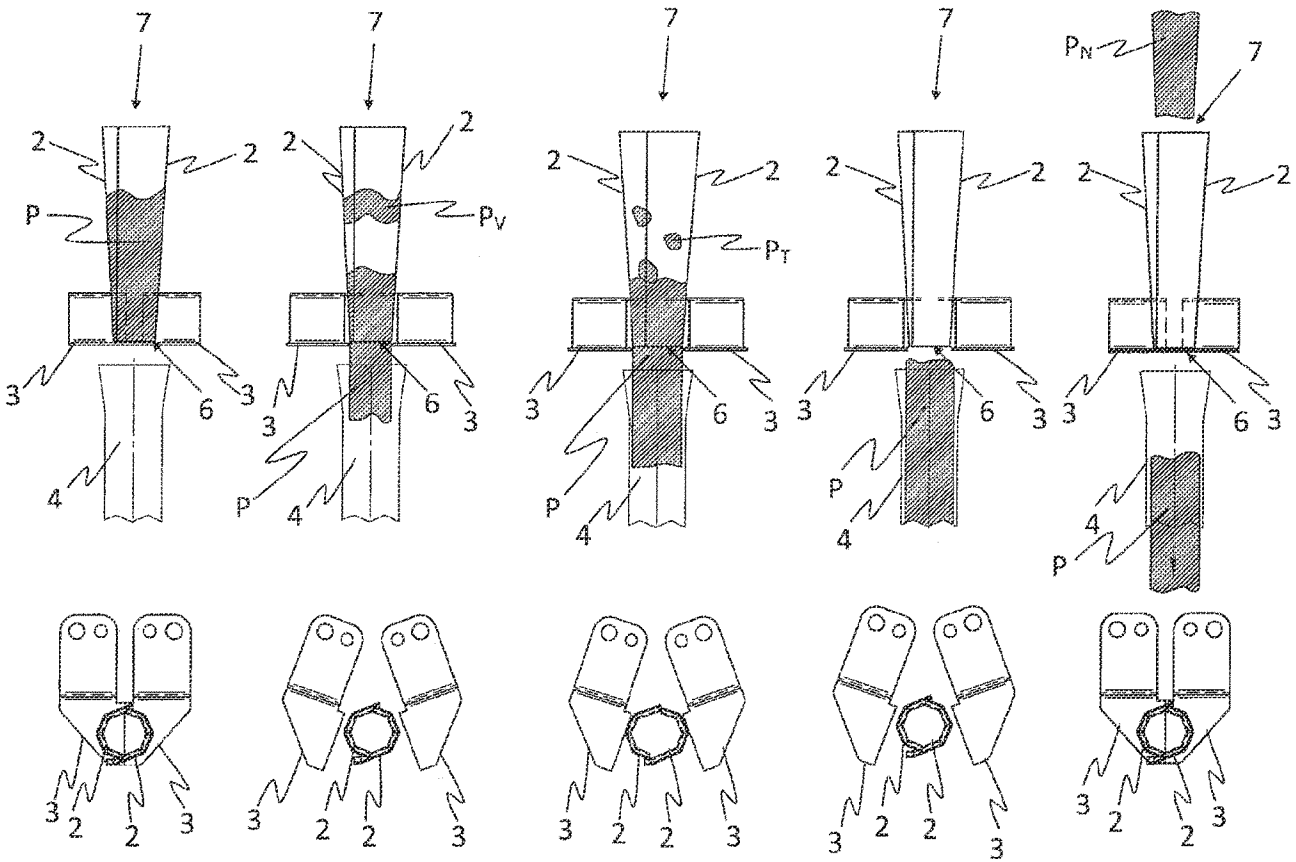
FIG. 4*a* through 4*e* describe the sequence of filling and emptying the container of FIG. 2. Herein, a top view and a sectional view of the container can be seen respectively in the figures.

FIGS. 4(*a*) through 4(*e*) describes the sequence of the typical filling process of a product. Herein, the following sequence of the filling/draining interval can be seen.

FIG. 4(*a*) Filling:

The side walls are in a position with narrow cross section, the opening flaps 3 are closed. The side walls 2 overlap at two locations. If product is filled into the container 1 from above, the product falls into the container 1, wherein the first product parts lie on the opening flaps 3.

FIG. 4(*b*) Opening:

In the first step of the opening process, the opening flaps 3 pivot away towards a side direction and therefore release the outlet 6 of the container 1. In comparison to FIG. 4(*a*), the position of the side walls 2 has not changed. The product P starts dropping out and falls into a funnel 4. The formatting of the product portion P is performed in this case via the diameter or the shape of the outlet 6. Furthermore, it can be seen that a part of the product P in the upper area of the container 1 has wedged or accumulated ($P_v$). Via the friction of the product P with the inner areas of the side walls 2, this part $P_H$ of the product portion P remains temporarily in the container 1 or drops out downwards in a slowed down manner with slow velocity.

FIG. 4(*c*) Opening:

In the second step of the opening process, the opening flaps 3 are still in the open state. However, both side walls 2 move towards a side direction in this step, i.e. move away from each other, and therefore cause an extended interior space of the container 1. Therefore, potentially tilted product accumulations or layers ($P_v$) come loose and fall down as well in parts $P_T$, so that they encounter the already falling mass of the product P, before they reach the funnel 4 together with the moving product P. In the cross sectional presentation it can be seen that, despite an open state, both side walls 2 still touch each other or overlap each other at two longitudinal edges of the outermost segment of the side walls 2.

FIG. 4(*d*) Closing:

In the first step of the closing process, both side walls 2 move towards each other again and, therefore, return to their initial position. However, this only occurs when the complete product portion P has dropped out or flown out of the container 1. The opening flaps 3 are still in the open state.

FIG. 4(*e*) Closing:

In the second step of the closing process, the opening flaps 3 close and return to their initial position. This also only occurs after the container 1 has emptied entirely. As soon as the opening flaps 3 are closed, new product $P_N$ can be filled into the container 1 from above again, which will lie on the opening flaps 3 in the next step again.

From FIGS. 1 to 3 and 4(*a*) through 4(*e*), it is furthermore obvious that the opening flaps 3 are pivotable in the horizontal plane towards a side direction during the opening process.

Both the movement of the side walls 2 and the movement of the opening flaps 3 is realized via a drive 5, which comprises levers 5*a* and rollers 5*b*. Thereby, the drive 5 both drives the side walls 2 and the opening flaps 3, so that the drive 5 is used as a common drive.

Herein, the drive is designed in a way, that firstly the releasing of the outlet occurs via pivoting the opening flaps 3, and subsequently, the extension of the cross section of the container 1 occurs via a movement of the side walls 2. Between the releasing of outlet 6 via pivoting the opening flaps 3 and the movement of the side walls 2, a certain time span t can exist. As a consequence, the product portion P being present in the container 1 starts dropping because of the pivoting of the opening flaps 3. Via the time span t, that much time is admitted, so that preferably the complete product portion P can start moving. Via the extension of the cross section of the container 1 by movement of the side walls 2, the tilted product parts $P_v$ can come loose and subsequently start moving, too. Therefore, it is ensured that the product portion P is released at most continuously or in a compact manner.

The above-mentioned container 1 can for example be used in a scale or combination scale.

The application is not limited to the specified embodiment. For example, the design of the container 1 is not limited to two side walls 2. The container 1 can also be composed of more than two side walls 2.

Furthermore, it is possible that the side walls consist of one or more circular-arc-shaped or polygonal parts. Altogether, the entire cross section of the container 1 can then be circular, oval, triangular, rectangular or polygonal. Also a polygonal cross section with rounded edges is possible. The entire cross section is then composed of the sum of the cross sections of all side walls.

For side walls composed of more segments, one segment at the outermost position can be designed wider compared to the remaining segments to enable an overlapping of the side walls 2. However, also cross sections of a side wall 2 are possible, wherein all segments are designed equally wide, the overlapping nevertheless being possible.

Depending on the nature of the product P, it is not mandatorily necessary that the side walls 2 overlap each other (for example in the case of very large product particles). Moreover, side walls 2 and drive 5 can be designed in a way, that a gap or a slit between the side walls 2 can be formed in the opened state, without the product P dropping out towards a side direction.

The opening flaps 3 can also be designed in a way that they are not pivotable in a horizontal plane, but move in a different direction for opening.

Furthermore, other shapes of the opening flaps 3 are possible, for example semi-circular shapes.

Furthermore, with regard to the conical internal shape of the container 1, further variations are considerable, e.g. the container can comprise a constant cross section or can become wider in a downward direction.

The present invention relates to a container 1 for use in a scale or combination scale for example, which is used as formatting container. Herein, it consists of two or more side walls 2, whose position with respect to each other is variable. The outlet 6 of the container 1 is closed by two or more opening flaps 3, which are however pivotable or swingable, and therefore, can release the outlet 6 of the container 1. There is a common drive 5, which both moves the side walls 2 and the opening flaps 3. Therefore, it is possible that a container 1 can be entirely emptied, as blocked or accumulated product parts can drop downwards via enlargement of the cross section of the container 1 by a movement of the side walls 2.

The invention claimed is:

1. A container comprising:

a plurality of side walls, the plurality of side walls defining a circumferential boundary of an internal space, at least one side wall being re-positionable with respect to the other side walls to vary a cross-sectional area of the internal space;

an inlet to the internal space; and an outlet from the internal space, the outlet being sealable;

a flap for sealing the outlet, the flap pivoting towards a side direction in a horizontal plane;

a single drive for re-positioning the at least one of the side walls and for opening the flap.

2. The container according to claim 1, wherein the at least one of the side walls comprises a circular arc-shaped or polygonal cross section.

3. The container according to claim 1, wherein a cross section of one side wall of the plurality of sidewalls comprises four segments, the four segments being substantially aligned in the shape of half of a continuous, regular octagon.

4. The container according to claim 3, wherein an outermost segment of the four segments is wider than the other segments of the four segments.

5. The container according to claim 1, wherein the side walls of the plurality of side walls overlap each other in the closed state.

6. The container according to claim 1, wherein the internal space comprises a substantially conical shape, wherein the conical shape is narrowest proximate to the outlet to accommodate a falling direction of the product portion.

7. The container according to claim 1, wherein the drive comprises a lever and a roller.

8. A scale comprising:

a scale comprising a container for improving a filling process of a product, the scale for measuring the product;

the container comprising a plurality of side walls, the plurality of side walls defining a circumferential boundary of an internal space, at least one side wall being re-positionable with respect to the other side walls to vary a cross-sectional area of the internal space;

an inlet to the internal space; and an outlet from the internal space, the outlet being sealable;

a flap for sealing the outlet, the flap pivoting towards a side direction in a horizontal plane;

a single drive for re-positioning the at least one of the side walls and for opening the flap.

9. A combination scale comprising:

in combination, a scale and a container, the container for improving a filling process of a product, the scale for measuring the product, the container comprising a plurality of side walls, the plurality of side walls defining a circumferential boundary of an internal space, at least one side wall being re-positionable with respect to the other side walls to vary a cross-sectional area of the internal space;

an inlet to the internal space; and an outlet from the internal space, the outlet being sealable;

a flap for sealing the outlet, the flap pivoting towards a side direction in a horizontal plane;

a single drive for re-positioning the at least one of the side walls and for opening the flap.

10. A method of using a container in a filling process, the container comprising a plurality of side walls, the plurality of side walls defining a circumferential boundary of an internal space, at least one side wall being re-positionable with respect to the other side walls to vary a cross-sectional area of the internal space;

an inlet to the internal space; and an outlet from the internal space, the outlet being sealable;

a flap for sealing the outlet, the flap pivoting towards a side direction in a horizontal plane;

a single drive for re-positioning the at least one of the side walls and for opening the flap;

the method comprising the steps of:

(a) opening the flap;

(b) subsequent to step (a), re-positioning of the at least one side wall to increase the cross-sectional area of the internal space.

11. The method according to claim 10, wherein step (b) is performed after step (a) after a predetermined time.

12. The method according to claim 10, wherein step (a) is performed by pivoting of the flap.

13. The container of claim 1, wherein at least two side walls of the plurality of side walls are re-positionable with respect to each other to vary a cross-sectional area of the internal space.

14. The method of claim 10, further comprising the steps of prior to step (a) providing a product to be filled in a packaging and passing the product into the container;

(c) subsequent to step (b) passing the product into a packaging.

* * * * *